US009856798B2

(12) United States Patent
Akazaki et al.

(10) Patent No.: US 9,856,798 B2
(45) Date of Patent: Jan. 2, 2018

(54) CONTROL DEVICE FOR INTERNAL COMBUSTION ENGINE

(71) Applicant: HONDA MOTOR CO., LTD., Tokyo (JP)

(72) Inventors: Shusuke Akazaki, Wako (JP); Taisuke Inoue, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 125 days.

(21) Appl. No.: 15/084,485

(22) Filed: Mar. 30, 2016

(65) Prior Publication Data

US 2016/0333802 A1 Nov. 17, 2016

(30) Foreign Application Priority Data

May 13, 2015 (JP) ..... 2015-098151

(51) Int. Cl.

| | |
|---|---|
| ***F02D 11/00*** | (2006.01) |
| ***F02D 35/00*** | (2006.01) |
| ***F02D 11/10*** | (2006.01) |
| ***F02D 35/02*** | (2006.01) |

(Continued)

(52) U.S. Cl.

CPC ..... *F02D 11/105* (2013.01); *F02D 35/023* (2013.01); *F02D 41/1403* (2013.01); *F02D 41/1497* (2013.01); *F02M 57/005* (2013.01); *F02D 2200/1002* (2013.01); *F02D 2250/18* (2013.01); *F02M 2200/247* (2013.01)

(58) Field of Classification Search

CPC .... F02D 11/105; F02D 11/106; F02D 35/023; F02D 41/1403; F02D 2041/1433; F02D 2200/1002; F02D 2250/18; F02D 2250/21; F02M 57/005

See application file for complete search history.

(56) References Cited

U.S. PATENT DOCUMENTS 4,933,857 A * 6/1990 Hashiguchi ..... B60L 3/10 180/197
5,069,181 A * 12/1991 Togai ..... F02D 11/105 123/350

(Continued)

FOREIGN PATENT DOCUMENTS

JP 4930634 B2 5/2012

*Primary Examiner* — Thomas Moulis
(74) *Attorney, Agent, or Firm* — Mori & Ward, LLP

(57) ABSTRACT

A control device for an internal combustion engine includes an in-cylinder pressure detector, an output shaft torque calculator, a target torque calculator, an input torque parameter calculator, and a controller. The output shaft torque calculator is to calculate an output shaft torque of an output shaft of the internal combustion engine based on an in-cylinder pressure. The target torque calculator is to calculate a target torque of the output shaft torque. The input torque parameter calculator is to calculate an input torque parameter representing an input torque such that the output shaft torque becomes equal to the target torque using a feedback control algorithm which is based on a controlled object model which models a controlled object that receives the input torque parameter as input and produces the output shaft torque as output. The controller is to control the output shaft torque using the input torque parameter.

11 Claims, 4 Drawing Sheets

(51) Int. Cl.
*F02D 41/14* (2006.01)
*F02M 57/00* (2006.01)

(56) References Cited

U.S. PATENT DOCUMENTS

| | | | | | |
|---|---|---|---|---|---|
| 5,078,109 | A * | 1/1992 | Yoshida | F02D 11/105 | 123/350 |
| 5,660,157 | A * | 8/1997 | Minowa | B60W 30/18 | 123/344 |
| 6,006,724 | A * | 12/1999 | Takahashi | F02D 11/105 | 123/339.19 |
| 6,434,466 | B1 * | 8/2002 | Robichaux | B60W 10/06 | 477/107 |
| 2007/0142937 | A1 * | 6/2007 | Yasui | F02D 35/023 | 700/29 |
| 2007/0270983 | A1 * | 11/2007 | Yasui | F02D 35/023 | 700/31 |
| 2008/0319633 | A1 * | 12/2008 | Moriya | F02D 35/023 | 701/103 |
| 2009/0164090 | A1 * | 6/2009 | Yasui | F02D 41/1403 | 701/102 |
| 2010/0057331 | A1 * | 3/2010 | Yamashita | F02D 9/02 | 701/103 |
| 2010/0116247 | A1 * | 5/2010 | Shikama | F02D 11/105 | 123/399 |
| 2013/0079987 | A1 * | 3/2013 | Matsumoto | F02D 41/1497 | 701/37 |
| 2015/0275784 | A1 * | 10/2015 | Whitney | F02D 13/02 | 701/102 |
| 2016/0237924 | A1 * | 8/2016 | Azizou | F02D 41/0072 | |

* cited by examiner

| VP \ AP | AP1 | ⋯ | APj |
|---|---|---|---|
| VP1 | TRQtgt11 | ⋯ | TRQtgt1j |
| ⋮ | ⋮ | ⋱ | ⋮ |
| VPi | TRQtgti1 | ⋯ | TRQtgtij |

CONTROL DEVICE FOR INTERNAL COMBUSTION ENGINE

CROSS-REFERENCE TO RELATED APPLICATIONS

The present application claims priority under 35 U.S.C. §119 to Japanese Patent Application No. 2015-098151, filed on May 13, 2015, entitled "Control Device for Internal Combustion Engine." The contents of this application are incorporated herein by reference in their entirety.

BACKGROUND

1. Field

The present disclosure relates to a control device for an internal combustion engine.

2. Description of the Related Art

Known control devices for internal combustion engines include a control device described in Japanese Patent No. 4930634. The control device is designed to control the ignition timing, and in an example of which shown in FIG. 5, the ignition timing is controlled by the following control algorithm. First, torque efficiency is calculated by dividing the required torque by an estimated torque calculated based on the opening of the throttle valve and the torque efficiency is converted to air quantity efficiency KL. By searching a map with reference to the efficiency KL, a feedforward control term for the amount of delay at 50% burn point is calculated.

In addition, based on detection signals from an in-cylinder pressure sensor, the torque that is actually being generated by the internal combustion engine (hereinafter referred to as "generated torque") is calculated, and a feedback control term is calculated by a PID control algorithm so that the deviation between the required torque and the generated torque converges to 0. Then, the amount of delay at 50% burn point is calculated by adding the feedback control term to the feedforward control term, the ignition timing is calculated by searching a map in accordance with the amount of delay and the number of revolutions of the engine NE, and the internal combustion engine is controlled so that it is actually ignited at the calculated timing.

SUMMARY

According to one aspect of the present invention, a control device for an internal combustion engine includes an in-cylinder pressure detection unit, an output shaft torque calculation unit, a target torque calculation unit, an input torque parameter calculation unit, and a control unit. The in-cylinder pressure detection unit detects an in-cylinder pressure which is a pressure inside a cylinder of an internal combustion engine. The output shaft torque calculation unit calculates an output shaft torque which is a torque of an output shaft of the internal combustion engine based on the detected in-cylinder pressure. The target torque calculation unit calculates a target torque serving as a target of the output shaft torque of the internal combustion engine. The input torque parameter calculation unit calculates an input torque parameter representing an input torque such that the detected output shaft torque becomes equal to the calculated target torque by using a predetermined feedback control algorithm which is based on a controlled object model which models a controlled object that receives the input torque parameter as input and produces the output shaft torque as output. The control unit controls the output shaft torque of the internal combustion engine using the calculated input torque parameter.

According to another aspect of the present invention, a control device for an internal combustion engine includes an in-cylinder pressure detector, an output shaft torque calculator, a target torque calculator, an input torque parameter calculator, and a controller. The in-cylinder pressure detector is to detect an in-cylinder pressure inside a cylinder of the internal combustion engine. The output shaft torque calculator is to calculate an output shaft torque of an output shaft of the internal combustion engine based on the in-cylinder pressure. The target torque calculator is to calculate a target torque of the output shaft torque. The input torque parameter calculator is to calculate an input torque parameter representing an input torque such that the output shaft torque becomes equal to the target torque using a feedback control algorithm which is based on a controlled object model which models a controlled object that receives the input torque parameter as input and produces the output shaft torque as output. The controller is to control the output shaft torque using the input torque parameter.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
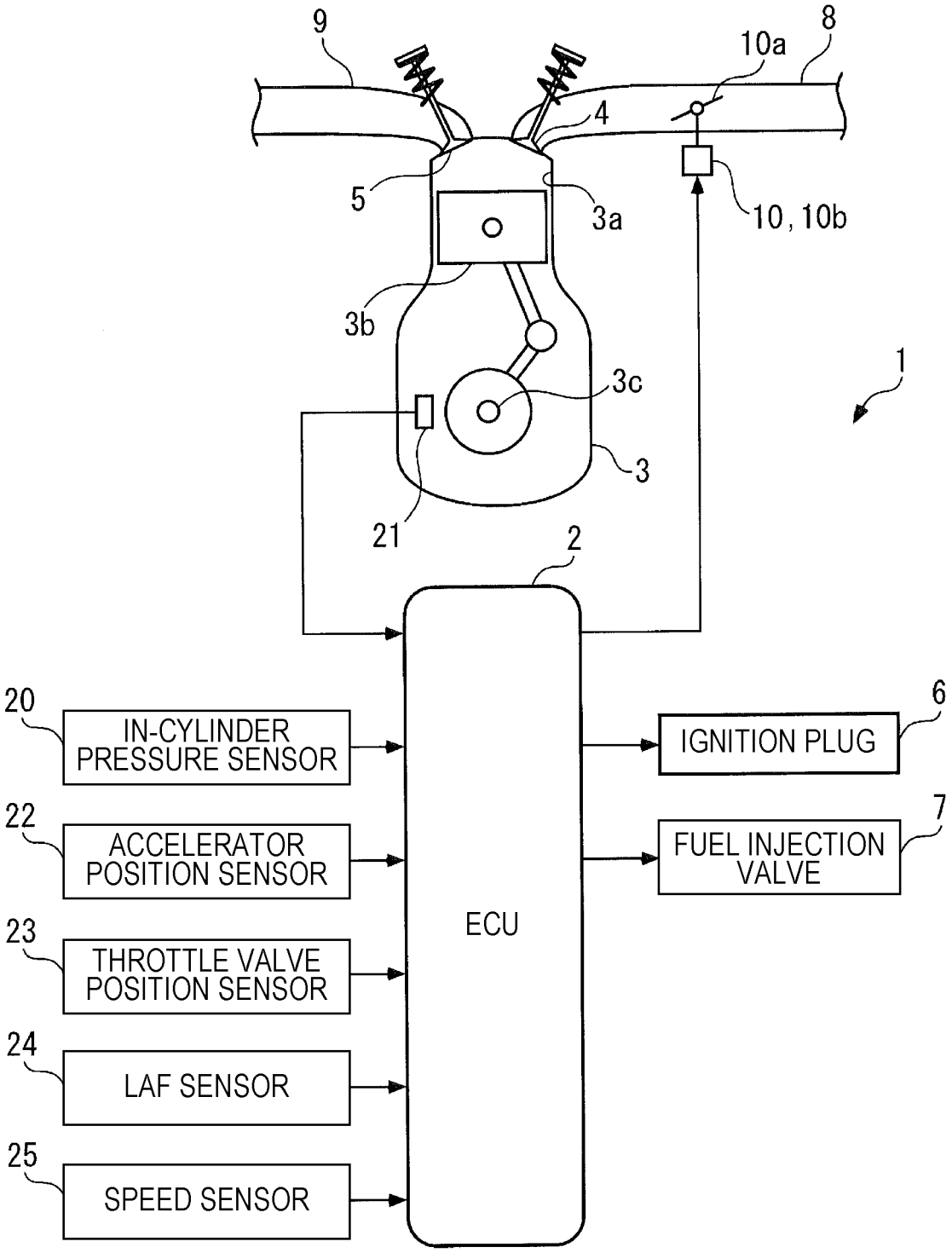
FIG. 1 is a diagram schematically showing the configuration of a control device according to an embodiment of the present disclosure and an internal combustion engine incorporating the same.

The embodiments will now be described with reference to the accompanying drawings, wherein like reference numerals designate corresponding or identical elements throughout the various drawings.

A control device for an internal combustion engine according to an embodiment of the present disclosure will be described below with reference to the drawings. Referring to FIG. 1, a control device 1 includes an ECU 2, which performs various kinds of processing for control including control of output shaft torque TRQact in response to the operation status of an internal combustion engine (hereinafter referred to as "engine") 3, as discussed later.

The engine 3 is an inline multi-cylinder gasoline engine having multiple sets of a cylinder 3*a* and a piston 3*b* (only one set is shown in FIG. 1) and incorporated in a vehicle (not shown) as the power source. The engine 3 also includes, for each one cylinder 3*a*, an intake valve 4, an exhaust valve 5, an ignition plug 6, and a fuel injection valve 7 (only one of each is shown in FIG. 1).

Although not illustrated, the engine 3 is equipped with a variable intake valve gear mechanism, with which the valve timing of the intake valve 4 can be freely changed.

The ignition plug 6 is attached to the cylinder head of the engine 3 and is electrically connected with the ECU 2, and the discharge timing of the ignition plug 6 is controlled by the ECU 2. That is, the timing of igniting air-fuel mixture is controlled.

The fuel injection valve 7 is attached to the cylinder head so as to inject fuel directly into each cylinder 3*a*. The fuel injection valve 7 is electrically connected with the ECU 2 so that the quantity and timing of fuel injection from the fuel injection valve 7 are controlled by the ECU 2.

Figure 2:
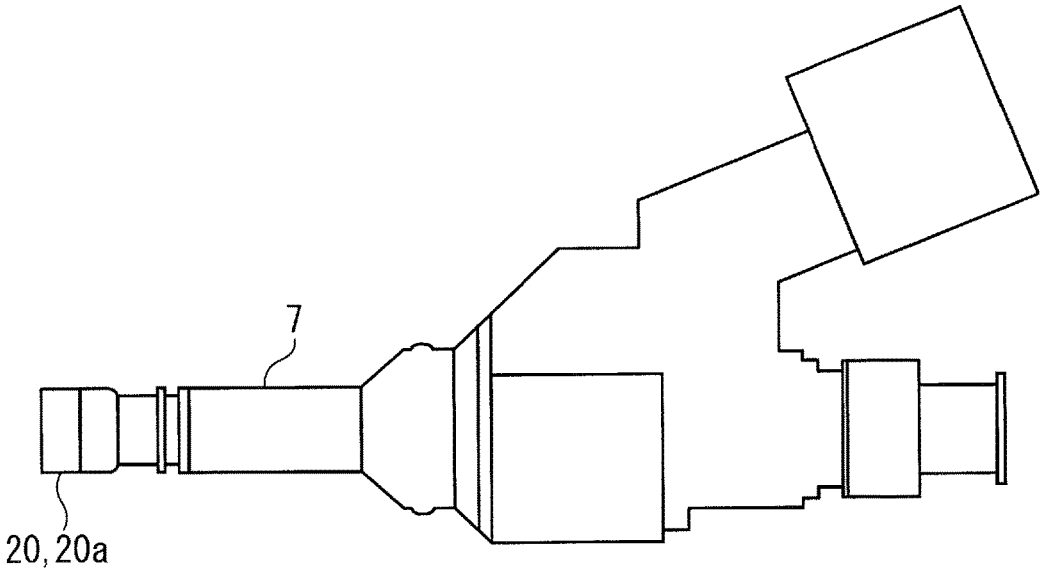
FIG. 2 shows the appearance of a fuel injection valve and an in-cylinder pressure sensor.

Also, as shown in FIG. 2, the fuel injection valve 7 is provided with an in-cylinder pressure sensor 20 (an in-cylinder pressure detection unit) at an end thereof as an integral part, where a detector 20*a* of the in-cylinder pressure sensor 20 is formed in an annular shape. With the fuel injection valve 7 attached to the cylinder head, the in-cylinder pressure sensor 20 detects the pressure inside the cylinder 3*a* (hereinafter referred to as "in-cylinder pressure") Pcyl and outputs a detection signal representing it to the ECU 2. Here, providing the in-cylinder pressure sensor 20 at the end of the fuel injection valve 7 enables accurate detection of the in-cylinder pressure Pcyl with reduced influence of vibration of the cylinder head compared to a washer-type in-cylinder pressure sensor.

The ECU 2 calculates the in-cylinder pressure Pcyl on the basis of the detection unit of the in-cylinder pressure sensor 20 and, based on the in-cylinder pressure Pcyl, calculates the output shaft torque TRQact by a known calculation method. For instance, indicated mean effective pressure Pmi is calculated based on the in-cylinder pressure Pcyl using the method described in Japanese Unexamined Patent Application Publication No. 2007-291924 (the entire contents of which are incorporated herein by reference), and the output shaft torque TRQact is calculated from the indicated mean effective pressure Pmi and the displacement of the engine 3. In this case, the output shaft torque TRQact corresponds to the torque output from a crank shaft 3*c* (the output shaft) of the engine 3.

A throttle valve mechanism 10 is disposed midway in an air inlet passage 8 and includes a throttle valve 10*a*, a TH actuator 10*b* for driving the opening and closing of the throttle valve 10*a*, and so forth. The throttle valve 10*a* is disposed midway in the air inlet passage 8 in a rotatable manner so that the flow rate of the air passing through the throttle valve 10*a* is varied by change in the degree of opening associated with its rotation.

The TH actuator 10*b* is a combination of a motor connected to the ECU 2 and a gear mechanism (both not shown) and varies the opening of the throttle valve 10*a* by being controlled by the ECU 2.

Further, to the ECU 2, a crank angle sensor 21, an accelerator position sensor 22, a throttle valve position sensor 23, an LAF sensor 24, and a speed sensor 25 are electrically connected. The crank angle sensor 21 outputs CRK signal, which is a pulse signal, to the ECU 2 in response to the rotation of the crank shaft 3*c*. One pulse of CRK signal is output for each predetermined crank angle (for example, 1°), and the ECU 2 calculates the number of revolutions of the engine 3 (hereinafter referred to as "engine r.p.m") NE based on the CRK signal.

The accelerator position sensor 22 detects the amount of pressing AP of the accelerator pedal (not shown) of the vehicle (hereinafter referred to as "accelerator position") and outputs a detection signal representing it to the ECU 2. The throttle valve position sensor 23 detects the degree of opening of the throttle valve 10*a* (hereinafter referred to as "throttle valve opening") TH and outputs a detection signal representing it to the ECU 2.

The LAF sensor 24 linearly detects the concentration of oxygen in the exhaust gas flowing in an exhaust passage 9 over a wide air-fuel ratio area ranging from a rich area richer than the theoretical air-fuel ratio to an extremely lean area, and outputs a detection signal representing it to the ECU 2. Based on the value of the detection signal from the LAF sensor 24, the ECU 2 calculates the oxygen concentration in the exhaust gas, air-fuel ratio, and the like.

The speed sensor 25 is attached on an axle (not shown) of the vehicle for detecting the driving speed of the vehicle (hereinafter referred to as "vehicle speed") VP and outputting a detection signal representing it to the ECU 2.

The ECU 2 is composed of a microcomputer including a CPU, RAM, ROM, an I/O interface, and the like (all not shown), and controls the output shaft torque TRQact, as discussed below, based on detection signals from the various sensors 20 to 25 and the like. In this embodiment, the ECU 2 corresponds to the output shaft torque calculation unit, the target torque calculation unit, the input torque parameter calculation unit, the control unit, and the on-board identification unit.

Figure 3:
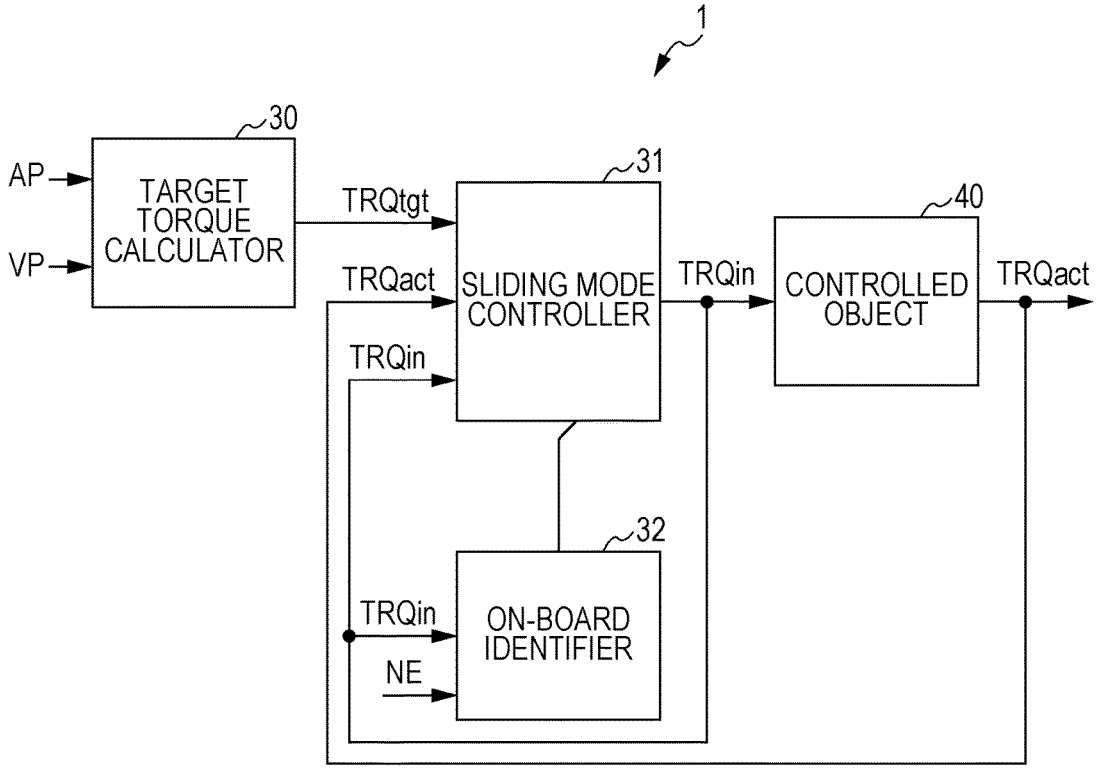
FIG. 3 is a block diagram showing the functional configuration of the control device.

Referring now to FIG. 3, the functional configuration of the control device 1 in this embodiment will be described. As shown in FIG. 3, the control device 1 functions to control a controlled object 40, and includes a target torque calculator 30, a sliding mode controller 31, and an on-board identifier 32. Specifically, the elements 30 to 32 are components of the ECU 2. The details of the controlled object 40 will be discussed later.

The target torque calculator 30 (the target torque calculation unit) calculates the target torque TRQtgt to serve as the target of the output shaft torque TRQact described above. The target torque TRQtgt is specifically calculated by searching the map shown in FIG. 4 as a function of the accelerator position AP and the vehicle speed VP.

The sliding mode controller 31 (the input torque parameter calculation unit) calculates the input torque TRQin (input torque parameter) with the sliding mode control algorithm described below. Note that each discrete data with symbol (k) used in the following calculation formulae indicates that the data has been calculated (or sampled) in synchronization with a predetermined period ΔT (for example, 10 msec), where symbol k (k being a positive integer) represents the order of the calculation (or sampling) cycle of each discrete data. For example, symbol k indicates that the data is the current value calculated at the current calculation timing, symbol k−1 indicates that the data is the immediately preceding value calculated at the last calculation timing, and so on. This applies to the following discrete data as well. In the descriptions below, symbol (k) may be omitted in each discrete data where appropriate.

First, the following error err is calculated by Formula (1):

$$\mathrm{err}(k)=\mathrm{TRQact}(k)-\mathrm{TRQtgt}(k) \tag{1}$$

Then, switching function σ is calculated by Formula (2) below, where S is a switching function configuration parameter, set to a value with which $-1<S<0$ holds.

$$\sigma(k)=\mathrm{err}(k)+S\cdot\mathrm{err}(k-1) \tag{2}$$

Next, equivalent control input Ueq is calculated by Formula (3):

$$Ueq(k) = -\frac{1}{b1} \{a1 \cdot TRQact(k-n1+n2) + a1 \cdot (S-1) \cdot TRQact(k-n1+n2-1) - S \cdot a1 \cdot TRQact(k-n1+n2-2) + b1 \cdot (S-1) \cdot TRQin(k-1) - S \cdot b1 \cdot TRQin(k-2) + C \cdot E(k+n2) + C \cdot (S-1) \cdot E(k+n2-1) - S \cdot C \cdot E(k+n2-2) - TRQtgt(k+n2) + (1-S) \cdot TRQtgt(k+n2-1) + S \cdot TRQtgt(k+n2-2)\} \quad (3)$$

In Formula (3), a1 and b1 are model parameters of the controlled object model shown in Formula (10) described below, and C is a disturbance gain matrix defined as shown in Formula (11) described below. E is an estimated disturbance vector defined as shown in Formula (12) described below, and n1 and n2 represent the dead times of output shaft torque TRQact and input torque TRQin in the controlled object model.

Further, nonlinear input Un1 is calculated by Formulae (4) through (6) below. In Formulae (4) and (6), Knl is a predetermined nonlinear gain.

If σ(k)>0;

$$Un1(k) = -1 \cdot \frac{1}{b1(k)} Kn1 \quad (4)$$

If σ(k)=0;

$$Un1(k)=0 \quad (5)$$

If σ(k)<0;

$$Un1(k) = \frac{1}{b1(k)} \cdot Kn1 \quad (6)$$

Next, reaching law input Urch is calculated by Formula (7), where Krch is a predetermined reaching law gain.

$$Urch(k) = \frac{1}{b1(k)} \cdot Krch \cdot \sigma(k) \quad (7)$$

Next, adaptation law input Uadp is calculated by Formula (8), where Kadp is a predetermined adaptation law gain.

$$Uadp(k) = \frac{1}{b1(k)} \sum_{i=0}^{k} (Kadp \cdot \sigma(i)) \quad (8)$$

Finally, the input torque TRQin is calculated by Formula (9):

$$\mathrm{TRQin}(k)=Ueq(k)+Un1(k)+Uadp(k)+Urch(k) \quad (9)$$

The control algorithm shown in Formulae (1) through (9) is derived as follows. The controlled object 40 in this embodiment is defined as a control system which receives the input torque TRQin as input and produces the output shaft torque TRQact as output, and to which the first to fourth estimated disturbance values e1 to e4 are applied as disturbance, and it is also modeled as a discrete time system model, yielding the controlled object model shown in Formulae (10) to (12) below. In the case of this controlled object model, its model parameters are also rendered as discrete data for the sake of identifying the model parameters by the on-board identifier 32.

$$TRQact(k) = a1(k) \cdot TRQact(k-n1) + b1(k) \cdot TRQin(k-n2) + C(k) \cdot E(k) \quad (10)$$

$$C(k) = [\,C1(k) \quad C2(k) \quad C3(k) \quad C4(k) \quad C5(k)\,] \quad (11)$$

$$E(k) = \begin{bmatrix} e1(k-n3) \\ e2(k-n4) \\ e3(k-n5) \\ e4(k-n6) \\ 1 \end{bmatrix} \quad (12)$$

The elements C1 through C4 of disturbance gain matrix C in Formula (11) are first to fourth disturbance gains, and element C5 is an expansion parameter gain for compensating for the steady-state deviation of the controlled object model. The elements C1 to C5 are calculated (identified) by the on-board identifier 32 as described later. The first to fourth estimated disturbance values e1 to e4 in Formula (12) are specifically the amount of variation in oxygen concentration in exhaust gas, and the amount of variation in valve timing of the intake valve 4, or the like, calculated by the ECU 2. Further, n3 to n6 in Formula (12) represent the dead times of the first to fourth estimated disturbance values e1 to e4. By applying the sliding mode control algorithm to the controlled object model shown in Formulae (10) through (12) such that the output shaft torque TRQact converges to the target torque TRQtgt, Formulae (1) through (9) are derived.

Since the sliding mode controller 31 calculates the input torque TRQin by the control algorithm described above, the input torque TRQin is calculated as a value that makes the output shaft torque TRQact follow the target torque TRQtgt. In addition, because the product C·E of the disturbance gain matrix and the estimated disturbance vector is contained in Formula (3) by which to calculate the equivalent control input Ueq, the input torque TRQin is calculated as a value capable of compensating for the influence of the four kinds of disturbance and the steady-state deviation of the controlled object model.

Next, the above-described on-board identifier 32 (on-board identification unit) will be described in detail. The on-board identifier 32 calculates parameter vector θ using the on-board identification algorithm shown in Formulae (13) through (21) below. The on-board identification algorithm is an application of an identification algorithm using a sequential least squares method and a δ-correction method algorithm to the controlled object model of the foregoing Formulae (10) through (12).

First, the parameter vector θ is a vector defined as shown in Formula (13) and calculated by Formula (14):

$$\theta(k) = \begin{bmatrix} a1(k) \\ b1(k) \\ C^T(k) \end{bmatrix} \quad (13)$$

$$\theta(k) = d\theta(k) + \theta base(k) \quad (14)$$

In Formula (14), dθ is a correction term vector defined as shown in Formula (15):

$$d\theta(k) = \begin{bmatrix} da1(k) \\ db1(k) \\ dC^T(k) \end{bmatrix} \tag{15}$$

Among the elements of the correction term vector dθ, da1 and db1 are correction terms, and dC is a matrix of one row and five columns having five correction terms dC1 through dC5 as its elements.

The term θbase in Formula (14) is a reference parameter vector defined as shown in Formula (16):

$$\theta base(k) = \begin{bmatrix} a1base(k) \\ b1base(k) \\ Cbase^T(k) \end{bmatrix} \tag{16}$$

Among the elements of the reference parameter vector θbase, a1base and b1base are model parameter reference values, calculated by searching a map (not shown) as a function of the engine r.p.m NE. Cbase is a matrix of one row and five columns having five reference estimated disturbance values C1base to C5base as its elements, which are also calculated by searching a map (not shown) as a function of the engine r.p.m NE. Note that the elements of the reference parameter vector θbase may also be set to fixed values without regard to the engine r.p.m NE.

The aforementioned correction term vector dθ is calculated by Formula (17):

$$d\theta(k)=\lambda\cdot d\theta(k-1)+K(k)\cdot\{\mathrm{TRQact}(k)-z^T(k)-z^T(k)\cdot[d\theta(k-1)+\theta\mathrm{base}(k)]\} \tag{17}$$

In Formula (17), λ is a forgetting factor matrix defined as shown in Formula (18):

$$\lambda = \begin{bmatrix} \lambda a1 & 0 & 0 \\ 0 & \lambda b1 & 0 \\ 0 & 0 & \lambda C \end{bmatrix} \tag{18}$$

Among the elements of the forgetting factor matrix λ, λa1 and λb1 are forgetting factors which are set to values greater than 0 and smaller than 1. The element λC is a matrix of one row and five columns having five forgetting factors λC1 through λC5 as its elements, where the five forgetting factors λC1 through λC5 are also set to values greater than 0 and smaller than 1.

K in Formula (17) is a gain matrix calculated with Formulae (19) through (21):

$$K(k) = \frac{P\cdot z(k)}{1 + z^T(k)\cdot P\cdot z(k)} \tag{19}$$

$$P = [\,Pa1 \quad Pb1 \quad PC\,] \tag{20}$$

$$z(k) = \begin{bmatrix} TRQact(k-n1) \\ TRQin(k-n2) \\ E(k) \end{bmatrix} \tag{21}$$

In Formula (19), P is a gain weight matrix defined as shown in Formula (20), in which Pa1 and Pb1 are predetermined gain weights. In Formula (20), PC is a gain weight matrix of one row and five columns having five predetermined gain weights PC1 through PC5 its elements, and z in Formula (19) is a vector defined as shown in Formula (21).

Figures 4, 5:
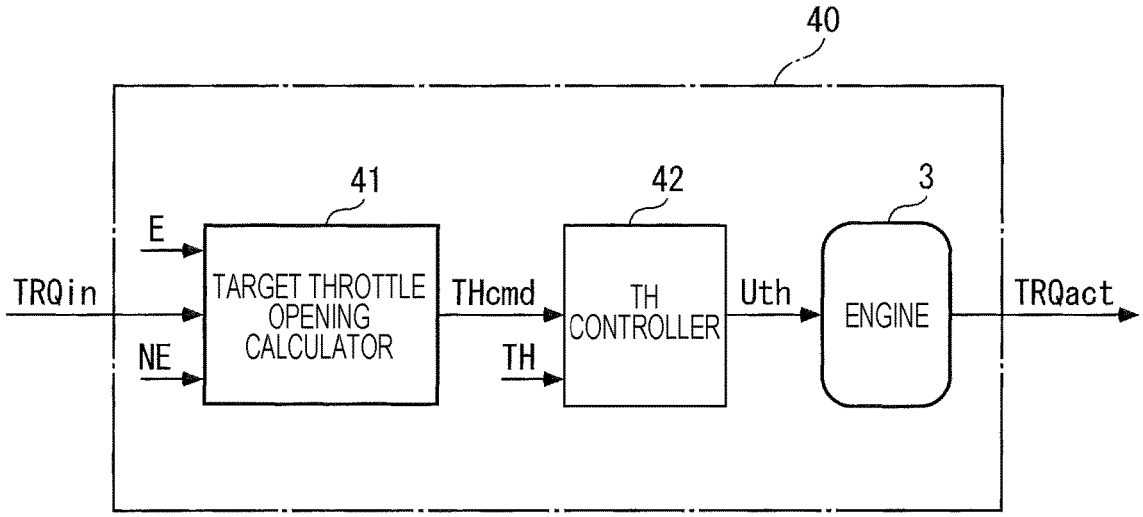
FIG. 4 shows an example of a map for use in calculation of target torque.
FIG. 5 is a block diagram for illustrating the controlled object of the present disclosure.

Referring now to FIG. 5, the controlled object 40 in this embodiment will be described. As described earlier, the controlled object 40 is defined as a control system that receives the input torque TRQin as input and produces the output shaft torque TRQact as output; specifically, it is designed to include a target throttle opening calculator 41, a TH controller 42, the engine 3, and the like as shown in FIG. 5. The two elements 41 and 42 are both components of the ECU 2.

The target throttle opening calculator 41 calculates a target opening THcmd (an intake air quantity parameter) serving as the target of the throttle valve opening TH by using a response surface model as described below. Specifically, when the input torque TRQin is equal to or greater than a predetermined decision value TRQref, that is, when the engine 3 is operating under medium to high load, the target opening THcmd is calculated with the response surface model shown in Formula (22):

If TRQin≥TRQref, $$\begin{aligned} THcmd(k) = {} & \mathrm{Offset_H} + G1\cdot TRQin(k) + G2\cdot NE(k) + G3\cdot e1(k) + \\ & G4\cdot e2(k) + G5\cdot e3(k) + G6\cdot e4(k) + G7\cdot TRQin(k)^2 + \\ & G8\cdot NE(k)\cdot TRQin(k) + G9\cdot e1(k)\cdot TRQin(k) + \\ & G10\cdot e2(k)\cdot TRQin(k) + G11\cdot e3(k)\cdot TRQin(k) + \\ & G12\cdot e4(k)\cdot TRQin(k) + G13\cdot NE(k)^2 + G14\cdot e1(k)\cdot NE(k) + \\ & G15\cdot e2(k)\cdot NE(k) + G16\cdot e3(k)\cdot NE(k) + G17\cdot e4(k)\cdot NE(k) + \\ & G18\cdot e1(k)^2 + G19\cdot e1(k)\cdot e2(k) + G20\cdot e1(k)\cdot e3(k) + \\ & G21\cdot e1(k)\cdot e4(k) + G22\cdot e2(k)^2 + G23\cdot e2(k)\cdot e3(k) + \\ & G24\cdot e2(k)\cdot e4(k) + G25\cdot e3(k)^2 + G26\cdot e3(k)\cdot e4(k) + G27\cdot e4(k)^2 \end{aligned} \tag{22}$$

In Formula (22), Offset_H is a predetermined offset value (a fixed value), and G1 through G27 are predetermined gains (fixed values).

Meanwhile, when TRQin<TRQref holds, that is, when the engine 3 is operating under low load, the target opening THcmd is calculated with the response surface model shown in Formula (23):

If TRQin<TRQref, $$\begin{aligned} THcmd(k) = {} & \mathrm{Offset_L} + G41\cdot TRQin(k) + G42\cdot NE(k) + G43\cdot e1(k) + \\ & G44\cdot e2(k) + G45\cdot e3(k) + G46\cdot e4(k) + G47\cdot TRQin(k)^2 + \\ & G48\cdot NE(k)\cdot TRQin(k) + G49\cdot e1(k)\cdot TRQin(k) + \\ & G50\cdot e2(k)\cdot TRQin(k) + G51\cdot e3(k)\cdot TRQin(k) + \\ & G52\cdot e4(k)\cdot TRQin(k) + G53\cdot NE(k)^2 + G54\cdot e1(k)\cdot NE(k) + \\ & G55\cdot e2(k)\cdot NE(k) + G56\cdot e3(k)\cdot NE(k) + G57\cdot e4(k)\cdot NE(k) + \\ & G58\cdot e1(k)^2 + G59\cdot e1(k)\cdot e2(k) + G60\cdot e1(k)\cdot e3(k) + \\ & G61\cdot e1(k)\cdot e4(k) + G62\cdot e2(k)^2 + G63\cdot e2(k)\cdot e3(k) + \\ & G64\cdot e2(k)\cdot e4(k) + G65\cdot e3(k)^2 + G66\cdot e3(k)\cdot e4(k) + G67\cdot e4(k)^2 \end{aligned} \tag{23}$$

In Formula (22), Offset_L is a predetermined offset value (a fixed value), and G41 through G67 are predetermined gains (fixed values).

Since the target throttle opening calculator 41 calculates the target opening THcmd in this manner, the target opening THcmd is calculated as a value that makes the output shaft torque TRQact follow the target torque TRQtgt while compensating for the influence of the four kinds of disturbance and the steady-state deviation of the controlled object model.

Further, the TH controller 42 calculates the TH control input Uth using a predetermined feedback control algorithm (for example, a sliding mode control algorithm) such that the throttle valve opening TH coincides with the target opening THcmd, and feeds a control input signal corresponding to the TH control input Uth to the TH actuator 9*b*. As a result, the output shaft torque TRQact is controlled so as to follow the target torque TRQtgt.

As described above, the control device 1 according to this embodiment calculates the in-cylinder pressure Pcyl based on a detection signal from the in-cylinder pressure sensor 20. Based on the in-cylinder pressure Pcyl, the output shaft torque TRQact is calculated, and also the target torque TRQtgt is calculated as a function of the accelerator position AP and the vehicle speed VP. Then, the input torque TRQin is calculated using the sliding mode control algorithm shown in Formulae (1) through (9) such that the output shaft torque TRQact becomes equal to the target torque TRQtgt, and using the input torque TRQin, the output shaft torque TRQact is controlled so as to become equal to the target torque TRQtgt. Thus, the accuracy of control of the output shaft torque TRQact can be improved compared to the control device described in Japanese Patent No. 4930634 (the entire contents of which are incorporated herein by reference) which controls the timing of ignition, which is only one of parameters that decide the generated torque of the internal combustion engine 3. Accordingly, the control device 1 can ensure high marketability.

In addition, the sliding mode control algorithm of Formulae (1) through (9) is derived based on the controlled object model shown in Formulae (10) through (12) that defines the relationship between the output shaft torque TRQact, the input torque TRQin, the four estimated disturbance values e1 through e4, and the expansion parameter gain C5. Thus, the equivalent control input Ueq for the algorithm is defined so as to contain the four estimated disturbance values e1 through e4 and the expansion parameter gain C5. Consequently, the output shaft torque TRQact can be accurately converged to the target torque TRQtgt and the accuracy of control can be further improved while compensating for the influence of the four kinds of disturbance corresponding to the four estimated disturbance values e1 through e4 and the steady-state deviation of the controlled object model.

Additionally, the on-board identifier 32 identifies four estimated disturbance values e1 through e4, four disturbance gains C1 through C4, and the expansion parameter gain C5 on board, and the input torque TRQin is calculated by use of those values identified on board. Therefore, in addition to the ability to compensate for the influence of the four kinds of disturbance corresponding to the four estimated disturbance values e1 through e4 and the steady-state deviation of the controlled object model, the input torque TRQin can be calculated while compensating for any deviation of the controlled object model from the actual state of the controlled object and a resulting increase in modeling errors, which can be caused by the individual difference and/or aging of the engine 3. This can improve the robustness of control, further enhancing the marketability.

Moreover, the controlled object 40 is defined as a control system that receives the input torque TRQin as input and produces the output shaft torque TRQact as output, and is composed of the target throttle opening calculator 41, the TH controller 42, the engine 3, and so forth. The target throttle opening calculator 41 selects one of the response surface models shown in Formulae (22) and (23) based on the magnitudes of input torque TRQin and the predetermined decision value TRQref, so an optimal response surface model can be chosen for the input torque TRQin. Also, the response surface models of Formulae (22) and (23) are linearizations of the relationship between the input torque TRQin, the engine r.p.m NE, the four estimated disturbance values e1 through e4, and the target opening THcmd. Accordingly, use of a response surface model thus selected enables accurate calculation of the target opening THcmd while compensating for the influence of the four kinds of disturbance corresponding to the four estimated disturbance values e1 through e4. As a result, the accuracy of control of the output shaft torque TRQact can be further improved.

Additionally, since the in-cylinder pressure sensor 20 in this embodiment is equipped with the annular-shaped detector 20*a* at the end of the fuel injection valve 7, the in-cylinder pressure Pcyl can be accurately detected with reduced influence of vibration of the cylinder head, compared to a typical in-cylinder pressure sensor having a detector of a washer-like shape and disposed between a device such as the ignition plug or fuel injection valve and the cylinder head. Consequently, with the improvement in the accuracy with which the in-cylinder pressure Pcyl is detected, the accuracy with which the output shaft torque TRQact is controlled can be further improved.

While the embodiment described above uses the in-cylinder pressure sensor 20 as the in-cylinder pressure detection unit, the in-cylinder pressure detection unit of the present disclosure is not limited thereto but may be any device capable of detecting the in-cylinder pressure. For example, the in-cylinder pressure detection unit may instead be a washer-type in-cylinder pressure sensor that is installed between the ignition plug, for example, and the cylinder head when the ignition plug is attached to the cylinder head.

While the embodiment described above uses the models shown in Formulae (10) through (12) as the controlled object model, the controlled object model of the present disclosure is not limited thereto but may be any modeling of a controlled object that receives the input torque parameter as input and produces the output shaft torque as output. For example, a model that omits the third term C(k)·E(k) on the right side in Formula (10) may be employed as the controlled object model. Alternatively, a model in which the third term C(k)·E(k) on the right side in Formula (10) has been replaced with one estimated disturbance value e1(*k*), two estimated disturbance values e1(*k*) and e2(*k*), three estimated disturbance values e1(*k*) to e3(*k*), or five or more estimated disturbance values may be employed as the controlled object model.

Furthermore, while the embodiment described above uses Formulae (22) and (23) as response surface models, the response surface models of the present disclosure are not limited thereto, but can be any linearization of the relationship between the input torque parameter, the number of revolutions of the internal combustion engine, n (n being an integer greater than 0) estimated disturbance values, and an intake air quantity parameter representing the intake air quantity of the internal combustion engine.

For example, the response surface model may be a model that does not include the term containing estimated disturbance values e2(*k*) to e4(*k*) in Formulae (22) and (23), a model that does not include the term containing estimated disturbance values e3(*k*) and e4(*k*), or a model that does not include the term containing estimated disturbance value e4(*k*). In such an implementation, a model in which the third term C(k)·E(k) on the right side in Formula (10) has been replaced with one estimated disturbance value e1(*k*), two estimated disturbance values e1(*k*) and e2(*k*), or three estimated disturbance values e1(*k*) through e3(*k*) may be used as the controlled object model.

While the embodiment described above uses the two response surface models shown in Formulae (22) and (23) as multiple response surface models, three or more response surface models may be used instead.

While the embodiment described above selects one of two response surface models as a function of the input torque TRQin, one of two response surface models may be selected as a function of the target torque TRQtgt instead.

While the embodiment described above uses the input torque TRQin as the input torque parameter, the input torque parameter of the present disclosure is not limited thereto but may be any value representing the input torque. For example, the intake air quantity may be used as the input torque parameter, or when the internal combustion engine is a diesel engine, the fuel injection quantity may be used as the input torque parameter.

While the embodiment described above uses a sliding mode control algorithm as the predetermined feedback control algorithm, the predetermined feedback control algorithm of the present disclosure is not limited thereto but may be any algorithm that can calculate the input torque parameter such that the output shaft torque becomes equal to the target torque. For example, the predetermined feedback control algorithm may be a back-stepping control algorithm, a PID control algorithm, or the like.

While the embodiment described above uses the target opening THcmd as the intake air quantity parameter, the intake air quantity parameter of the present disclosure is not limited thereto but may be any quantity that represents the intake air quantity of the internal combustion engine. For example, throttle valve opening TH may be used as the intake air quantity parameter, or if the intake air quantity of the internal combustion engine is controlled only by a variable intake valve gear mechanism, the amount of action of the variable intake valve gear mechanism may be used as the intake air quantity parameter.

While the embodiment described above illustrates a case of applying the control device according to the present disclosure to an internal combustion engine for a vehicle, the control device of the present disclosure is not limited thereto but it is also applicable to internal combustion engines for ships or other industrial equipment.

While the embodiment described above uses a gasoline engine as the internal combustion engine, an internal combustion engine that runs on light oil, LPG, or blended fuel (for example, a mixture of gasoline and alcohol) may be used instead.

According to a first aspect of the present disclosure, a control device 1 for an internal combustion engine 3 includes an in-cylinder pressure detection unit (in-cylinder pressure sensor 20) that detects an in-cylinder pressure Pcyl which is a pressure inside a cylinder 3*a* of an internal combustion engine 3; an output shaft torque calculation unit (ECU 2) that calculates an output shaft torque TRQact which is a torque of an output shaft (crank shaft 3*c*) of the internal combustion engine 3 based on the detected in-cylinder pressure Pcyl; a target torque calculation unit (ECU 2, target torque calculator 30) that calculates a target torque TRQtgt serving as a target of the output shaft torque TRQact of the internal combustion engine 3; an input torque parameter calculation unit (ECU 2, sliding mode controller 31) that calculates an input torque parameter representing an input torque (input torque TRQin) such that the detected output shaft torque TRQact becomes equal to the calculated target torque TRQtgt by using a predetermined feedback control algorithm [Formulae (1) through (9)] which is based on a controlled object model [Formulae (10) through (12)] which models a controlled object 40 that receives the input torque parameter (input torque TRQin) as input and produces the output shaft torque TRQact as output; and a control unit (ECU 2) that controls the output shaft torque TRQact of the internal combustion engine 3 using the calculated input torque parameter (input torque TRQin).

According to this control device for an internal combustion engine, the in-cylinder pressure, or the pressure inside a cylinder of the internal combustion engine, is detected, and based on it, the output shaft torque which is the torque of the output shaft of the internal combustion engine is calculated, and a target torque serving as the target of the output shaft torque is calculated. Then, using a predetermined feedback control algorithm which is based on a controlled object model which models a controlled object that receives the input torque parameter representing the input torque as input and produces the output shaft torque as output, the input torque parameter is calculated such that the detected output shaft torque becomes equal to the calculated target torque, and the output shaft torque of the internal combustion engine is controlled using the input torque parameter thus calculated. Accordingly, since the output shaft torque is controlled using an input torque parameter calculated using the feedback control term alone, the accuracy of control of the output shaft torque can be improved compared to the control device described in Japanese Patent No. 4930634, which uses the sum of the feedback control term and the feedforward control term. Furthermore, since the input torque parameter is used to control the output shaft torque, the accuracy of control of the output shaft torque can be further improved compared to the control device described in Japanese Patent No. 4930634 which controls the timing of ignition, which is only one of parameters that decide the generated torque of the internal combustion engine. As a result, the control device of the present disclosure can ensure high marketability.

According to a second aspect of the present disclosure, in the control device 1 for the internal combustion engine 3 described in the first aspect, the controlled object 40 may be a control system that includes a plurality of response surface models [Formulae (22), (23)] representing linearization of a relationship between the input torque parameter (input torque TRQin), a number of revolutions NE of the internal combustion engine 3, n (n being an integer greater than 0) estimated disturbance values e1 through e4, and an intake air quantity parameter (target opening THcmd) representing an intake air quantity of the internal combustion engine 3; and the control unit may select one of the response surface models [Formulae (22), (23)] as a function of either one of the input torque parameter (input torque TRQin) and the target torque TRQtgt, and calculate the intake air quantity parameter (target opening THcmd) using the response surface model selected, and control the output shaft torque TRQact of the internal combustion engine 3 using the calculated intake air quantity parameter (target opening THcmd).

This control device for an internal combustion engine can select an optimal response surface model for the input torque parameter or the target torque because the controlled object is a control system that includes multiple response surface models representing linearization of the relationship between the input torque parameter, the number of revolutions of the internal combustion engine, n (n being an integer greater than 0) estimated disturbance values, and an intake air quantity parameter representing the intake air quantity of the internal combustion engine, and one of the response surface models is selected as a function of either one of the input torque parameter and the target torque. Moreover, since the intake air quantity parameter is calculated using the response surface model thus selected, the intake air quantity parameter can be accurately calculated as a function of the input torque parameter or the target torque while compensating for the influence of n kinds of disturbance corresponding to the n estimated disturbance values. Additionally, since the output shaft torque of the internal combustion engine is controlled using the intake air quantity parameter thus calculated, the accuracy of control of the output shaft torque can be improved.

According to a third aspect of the present disclosure, in the control device 1 for the internal combustion engine 3 described in the first aspect, the controlled object model may be a model [Formulae (10) through (12)] that defines a relationship between the input torque parameter (input torque TRQin), the output shaft torque TRQact, and m (m being an integer greater than 2) estimated disturbance values e1 through e4, and the predetermined feedback control algorithm may be a sliding mode control algorithm [Formulae (1) through (9)] that contains equivalent control input Ueq configured to contain the m estimated disturbance values e1 through e4.

According to this control device for an internal combustion engine, the controlled object model is a model that defines the relationship between the input torque parameter, the output shaft torque, and m (m being an integer greater than 2) estimated disturbance values, and the predetermined feedback control algorithm is a sliding mode control algorithm that contains equivalent control input configured to contain the m estimated disturbance values. Thus, the output shaft torque can be accurately converged to the target torque and the accuracy of control can be further improved while compensating for the influence of m kinds of disturbance corresponding to the m estimated disturbance values by means of an input torque parameter calculated using equivalent control input containing the m estimated disturbance values.

According to a fourth aspect of the present disclosure, the control device 1 for the internal combustion engine 3 described in the third aspect may further include an on-board identification unit (ECU 2, on-board identifier 32) that identifies model parameters a1 and b1 for the controlled object model and the m estimated disturbance values e1 through e4 on board, in which the input torque parameter calculation unit may calculate the input torque parameter (input torque TRQin) using, in combination with the predetermined feedback control algorithm, the model parameters a1 and b1 and the m estimated disturbance values e1 through e4 identified on board.

According to this control device for an internal combustion engine, model parameters for the controlled object model and the m estimated disturbance values are identified on board, and the input torque parameter is calculated using the model parameters and m estimated disturbance values identified on board in combination with the predetermined feedback control algorithm. It is thereby possible to calculate the input torque parameter while compensating for the influence of m kinds of disturbance corresponding to the m estimated disturbance values, and also compensating for any deviation of the controlled object model from the actual state of the controlled object and a resulting increase in modeling errors, which can be caused by the individual difference and/or aging of the internal combustion engine. This can improve the robustness of control, further enhancing the marketability.

According to a fifth aspect of the present disclosure, in the control device 1 for the internal combustion engine 3 described in one of the first to fourth aspects, the internal combustion engine 3 may include a fuel injection valve 7 for injecting fuel directly into the cylinder 3*a*, and the in-cylinder pressure detection unit (in-cylinder pressure sensor 20) may include an annular-shaped detector 20*a* at an end of the fuel injection valve 7.

The detector of an in-cylinder pressure detection unit, such as an in-cylinder pressure sensor, is typically formed in a washer-like shape and disposed between a device such as the ignition plug or fuel injection valve and the cylinder head of the internal combustion engine when the device is attached to the cylinder head. An in-cylinder pressure detection unit of this type is susceptible to vibration of the cylinder head, causing reduction in the accuracy of detection of the in-cylinder pressure. In contrast, according to this control device for an internal combustion engine, the in-cylinder pressure detection unit includes an annular-shaped detector at an end of the fuel injection valve, thereby allowing the in-cylinder pressure to be detected with reduced influence of vibration of the cylinder head. Consequently, with the improvement in the accuracy with which the in-cylinder pressure is detected, the accuracy with which the output shaft torque of the internal combustion engine is controlled can be further improved.

Obviously, numerous modifications and variations of the present invention are possible in light of the above teachings. It is therefore to be understood that within the scope of the appended claims, the invention may be practiced otherwise than as specifically described herein.

What is claimed is:

1. A control device for an internal combustion engine, comprising:

an in-cylinder pressure detection unit that detects an in-cylinder pressure which is a pressure inside a cylinder of an internal combustion engine;

an output shaft torque calculation unit that calculates an output shaft torque which is a torque of an output shaft of the internal combustion engine based on the detected in-cylinder pressure;

a target torque calculation unit that calculates a target torque serving as a target of the output shaft torque of the internal combustion engine;

an input torque parameter calculation unit that calculates an input torque parameter representing an input torque such that the detected output shaft torque becomes equal to the calculated target torque by using a predetermined feedback control algorithm which is based on a controlled object model which models a controlled object that receives the input torque parameter as input and produces the output shaft torque as output; and a control unit that controls the output shaft torque of the internal combustion engine using the calculated input torque parameter.

2. The control device for an internal combustion engine according to claim 1, wherein the controlled object is a control system that includes a plurality of response surface models representing linearization of a relationship between the input torque parameter, a number of revolutions of the internal combustion engine, n estimated disturbance values, n being an integer greater than 0, and an intake air quantity parameter representing an intake air quantity of the internal combustion engine, and the control unit selects one of the response surface models as a function of either one of the input torque parameter and the target torque, and calculates the intake air quantity parameter using the response surface model selected, and controls the output shaft torque of the internal combustion engine using the calculated intake air quantity parameter.

3. The control device for an internal combustion engine according to claim 1, wherein the controlled object model is a model that defines a relationship between the input torque parameter, the output shaft torque, and m estimated disturbance values, m being an integer greater than 2, and the predetermined feedback control algorithm is a sliding mode control algorithm that contains equivalent control input configured to contain the m estimated disturbance values.

4. The control device for an internal combustion engine according to claim 3, further comprising:

an on-board identification unit that identifies model parameters for the controlled object model and the m estimated disturbance values on board, wherein the input torque parameter calculation unit calculates the input torque parameter using, in combination with the predetermined feedback control algorithm, the model parameters and the m estimated disturbance values identified on board.

5. The control device for an internal combustion engine according to claim 1, wherein the internal combustion engine includes a fuel injection valve for injecting fuel directly into the cylinder, and the in-cylinder pressure detection unit includes an annular-shaped detector at an end of the fuel injection valve.

6. A control device for an internal combustion engine, comprising:

an in-cylinder pressure detector to detect an in-cylinder pressure inside a cylinder of the internal combustion engine;

an output shaft torque calculator to calculate an output shaft torque of an output shaft of the internal combustion engine based on the in-cylinder pressure;

a target torque calculator to calculate a target torque of the output shaft torque;

an input torque parameter calculator to calculate an input torque parameter representing an input torque such that the output shaft torque becomes equal to the target torque using a feedback control algorithm which is based on a controlled object model which models a controlled object that receives the input torque parameter as input and produces the output shaft torque as output; and a controller to control the output shaft torque using the input torque parameter.

7. The control device according to claim 6, wherein the controlled object includes response surface models representing linearization of a relationship between the input torque parameter, a number of revolutions of the internal combustion engine, n estimated disturbance values, n being an integer greater than 0, and an intake air quantity parameter representing an intake air quantity of the internal combustion engine, and the controller selects one of the response surface models as a function of either one of the input torque parameter and the target torque, and calculates the intake air quantity parameter using the one of the response surface models, and controls the output shaft torque of the internal combustion engine using the intake air quantity parameter.

8. The control device according to claim 6, wherein the controlled object model defines a relationship between the input torque parameter, the output shaft torque, and m estimated disturbance values, m being an integer greater than 2, and the feedback control algorithm is a sliding mode control algorithm that contains equivalent control input configured to contain the m estimated disturbance values.

9. The control device according to claim 8, further comprising:

an on-board identifier to identify model parameters for the controlled object model and the m estimated disturbance values on board, wherein the input torque parameter calculator calculates the input torque parameter using, in combination with the feedback control algorithm, the model parameters and the m estimated disturbance values identified on board.

10. The control device for an internal combustion engine according to claim 6, wherein the internal combustion engine includes a fuel injection valve for injecting fuel directly into the cylinder, and the in-cylinder pressure detector includes an annular-shaped detector at an end of the fuel injection valve.

11. A control device for an internal combustion engine, comprising:

in-cylinder pressure detection means for detecting an in-cylinder pressure inside a cylinder of the internal combustion engine;

output shaft torque calculation means for calculating an output shaft torque of an output shaft of the internal combustion engine based on the in-cylinder pressure;

target torque calculation means for calculating a target torque of the output shaft torque;

input torque parameter calculation means for calculating an input torque parameter representing an input torque such that the output shaft torque becomes equal to the target torque using a feedback control algorithm which is based on a controlled object model which models a controlled object that receives the input torque parameter as input and produces the output shaft torque as output; and control means for controlling the output shaft torque using the input torque parameter.

* * * * *